US006528189B1

(12) United States Patent
Beele

(10) Patent No.: US 6,528,189 B1
(45) Date of Patent: Mar. 4, 2003

(54) ARTICLE WITH A PROTECTIVE COATING SYSTEM INCLUDING AN IMPROVED ANCHORING LAYER AND METHOD OF MANUFACTURING THE SAME

(75) Inventor: Wolfram Beele, Ratingen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/211,109

(22) Filed: Dec. 14, 1998

Related U.S. Application Data

(63) Continuation of application No. PCT/EP97/02861, filed on Jun. 2, 1997.

(30) Foreign Application Priority Data

Jun. 13, 1996 (DE) ..... 96 109 537

(51) Int. Cl.[7] ..... B32B 15/04; F03B 3/12

(52) U.S. Cl. ..... 428/698; 428/469; 428/627; 428/632; 428/650; 428/655; 428/668; 428/680; 416/241 B

(58) Field of Search ..... 428/623, 627, 428/628, 629, 633, 678, 668, 680, 472, 698, 632, 650, 655, 469; 416/241 B

(56) References Cited

U.S. PATENT DOCUMENTS

| | | | | |
|---|---|---|---|---|
| 4,055,705 A | | 10/1977 | Stecura et al. | |
| 4,321,310 A | | 3/1982 | Ulion et al. | |
| 4,321,311 A | | 3/1982 | Strangman | |
| 5,087,477 A | | 2/1992 | Giggins, Jr. et al. | |
| 5,154,855 A | | 10/1992 | Sekiguchi et al. | |
| 5,238,752 A | | 8/1993 | Duderstadt et al. | |
| 5,262,245 A | | 11/1993 | Ulion et al. | |
| 5,268,238 A | | 12/1993 | Czech et al. | |
| 5,273,712 A | | 12/1993 | Czech et al. | |
| 5,401,307 A | | 3/1995 | Czech et al. | |
| 5,484,263 A | | 1/1996 | Nagaraj et al. | |
| 5,985,467 A | * | 11/1999 | Beele | 428/623 |

FOREIGN PATENT DOCUMENTS

| | | |
|---|---|---|
| EP | 0 446 988 A1 | 9/1991 |
| EP | 0 688 889 A1 | 12/1995 |

* cited by examiner

*Primary Examiner*—Deborah Jones
*Assistant Examiner*—Jennifer McNeil
(74) *Attorney, Agent, or Firm*—Laurence A. Greenberg; Werner H. Stemer; Ralph E. Locher

(57) ABSTRACT

In order to form a novel article of manufacture, a nickel or cobalt-based superalloy substrate is covered with a protective system resistant to thermal, corrosive and erosive attack. A bonding layer is disposed on the substrate and an anchoring layer on the bonding layer. The anchoring layer is formed as a nitride compound. The nitride compound is aluminum nitride in particular. A ceramic coating is disposed on the anchoring layer. The anchoring layer prevents transmission of diffusion active elements through the anchoring layer to the thermal barrier layer, reduces oxidation of layers therebelow and provides for good heat transmission therethrough.

30 Claims, 4 Drawing Sheets

ARTICLE WITH A PROTECTIVE COATING SYSTEM INCLUDING AN IMPROVED ANCHORING LAYER AND METHOD OF MANUFACTURING THE SAME

CROSS-REFERENCE TO RELATED APPLICATION

This application is a continuation of copending International application No. PCT/EP97/02861, filed on Jun. 2, 1997, which designated the United States.

BACKGROUND OF THE INVENTION

Field of the Invention

The invention relates to an article of manufacture, including a substrate formed of a nickel or cobalt-based superalloy, an anchoring layer placed on the substrate and a ceramic coating placed on the anchoring layer. The invention also relates to a method of placing a ceramic coating on an article of manufacture including a substrate formed of a nickel or cobalt-based superalloy, the method which includes placing an anchoring layer on the substrate and placing the ceramic coating on the anchoring layer.

The invention in particular relates to an article of manufacture to be used as a gas turbine component which is subjected to a hot and oxidizing gas stream streaming along it in operation. Such gas turbine components include gas turbine airfoil components like blades and vanes as well as gas turbine heat shield components.

U.S. Pat. No. 4,055,705 to Stecura et al.; U.S. Pat. No. 4,321,310 to Ulion et al., and U.S. Pat. No. 4,321,311 to Strangman disclose coating systems for gas turbine components made from nickel or cobalt-based superalloys. A coating system described includes a thermal barrier layer made from ceramic, which in particular has a columnar grained structure, placed on a bonding layer or bond coating which in its turn is placed on the substrate and bonds the thermal barrier layer to the substrate. The bonding layer is made from an alloy of the MCrAlY type, namely an alloy containing chromium, aluminum and a rare earth metal such as yttrium in a base including at least one of iron, cobalt and nickel. Further elements can also be present in an MCrAlY alloy; examples are given below. An important feature of the bonding layer is a thin layer developed on the MCrAlY alloy and used for anchoring the thermal barrier layer. This layer may be alumina, alumina mixed with chromium oxide or a double layer of alumina facing the thermal barrier layer and chromium oxide facing the bonding layer, depending on the composition of the MCrAlY alloy and the temperature of the oxidizing environment where the layer is developed. Eventually, an alumina layer may be placed purposefully by a separate coating process like physical vapor deposition (PVD).

U.S. Pat. No. 5,238,752 to Duderstadt et al. discloses a coating system for a gas turbine component which also incorporates a ceramic thermal barrier layer and a bonding layer or bond coating bonding the thermal barrier layer to the substrate. The bonding layer is made from an intermetallic aluminide compound, in particular a nickel aluminide or a platinum aluminide. The bonding layer also has a thin alumina layer which serves to anchor the thermal barrier layer.

U.S. Pat. No. 5,262,245 to Ulion et al. describes a result of an effort to simplify coating systems incorporating thermal barrier layers for gas turbine components by avoiding a bonding layer to be placed below the thermal barrier layer.

To this end, a composition for a superalloy is disclosed which may be used to form a substrate of a gas turbine component and which develops an alumina layer on its outer surfaces under a suitable treatment. That alumina layer is used to anchor a ceramic thermal barrier layer directly on the substrate, eliminating the need for a special bonding layer to be interposed between the substrate and the thermal barrier layer. In its broadest scope, the superalloy is formed essentially of, as specified in weight percent: 3 to 12 Cr, 3 to 10 W, 6 to 12 Ta, 4 to 7 Al, 0 to 15 Co, 0 to 3 Mo, 0 to 15 Re, 0 to 0.0020 B, 0 to 0.045 C, 0 to 0.8 Hf, 0 to 2 Nb, 0 to 1 V, 0 to 0.01 Zr, 0 to 0.07 Ti, 0 to 10 of the noble metals, 0 to 0.1 of the rare earth metals including Sc and Y, balance Ni.

U.S. Pat. No. 5,087,477 to Giggins, Jr., et al. shows a method for placing a ceramic thermal barrier layer on a gas turbine component by a physical vapor deposition process including evaporating compounds forming the thermal barrier layer with an electron beam and establishing an atmosphere having a controlled content of oxygen at the component to receive the thermal barrier layer.

U.S. Pat. No. 5,484,263 to B. A. Nagaraj et al. shows a metal article having a heat shield including: a barrier layer on a surface of the article and a reflective layer on the barrier layer. The reflective layer being formed from a material which is selected from the group formed of the noble metals, noble metal alloys and aluminum. The barrier layer may be an oxide or a nitride.

European Patent Application 0 446 988 A1 to V. Andoncecchi et al. shows a process for forming a silicon carbide coating on a nickel-based superalloy, including nitriding pretreatment of the superalloy or deposition of a film of titanium nitride on the superalloy by reactive sputtering. Thereafter a thin film of titanium nitride is being deposed using vapor-phase chemical deposition. After this the nickel-based superalloys annealed in a nitrogen and hydrogen atmosphere and a silicon carbide layer is placed using vapor-phase chemical deposition. With this process a coating is obtained wherein between a ceramic layer containing silicion carbide or silicion nitride and a superalloy an intermediate layer containing titanium nitride is being interposed.

European Patent Application 0 688 889 A1 to P. Broutin et al. shows a process for passivating the surface of a metallic article formed of a nickel-based superalloy. This metallic article is a stove-pipe or the like. On the substrate formed of the nickel-based superalloy a protective layer is applied containing silicion carbide or silicion nitride. Between the ceramic protective layer and the substrate an intermediate layer formed of aluminum nitride or titan aluminum nitride is interposed. The intermediate layer has a thickness of 0.15 to 5 $\mu$m which is less than a thickness of the protective layer.

U.S. Pat. Nos. 5,154,885; 5,268,238; 5,273,712; and 5,401,307, all to Czech et al. disclose advanced coating systems for gas turbine components including protective coatings of MCrAlY alloys. The MCrAlY alloys disclosed have carefully balanced compositions to give exceptionally good resistance to corrosion and oxidation as well as an exceptionally good compatibility to the superalloys used for the substrates. The basis of the MCrAlY alloys is formed by nickel and/or cobalt. Additions of further elements, in particular silicon and rhenium, are also discussed. Rhenium in particular is shown to be a very advantageous additive. All MCrAlY alloys shown are also very suitable as bonding layers for anchoring thermal barrier layers, particularly in the context of the invention disclosed hereinbelow.

The aforementioned U.S. Pat. No. 5,401,307 also contains a survey over superalloys which are considered useful for forming gas turbine components that are subject to high mechanical and thermal loads during operation. Particularly, four classes of superalloys are given. The respective superalloys are formed essentially of, as specified in percent by weight:

1. 0.03 to 0.05 C, 18 to 19 Cr, 12 to 15 Co, 3 to 6 Mo, 1 to 1.5 W, 2 to 2.5 Al, 3 to 5 Ti, optional minor additions of Ta, Nb, B and/or Zr, balance Ni. These alloys are brought into shape by forging; examples are specified as Udimet 520 or Udimet 720 by usual standard.

2. 0.1 to 0.15 C, 18 to 22 Cr, 18 to 19 Co, 0 to 2 W, 0 to 4 Mo, 0 to 1.5 Ta, 0 to 1 Nb, 1 to 3 Al, 2 to 4 Ti, 0 to 0.75 Hf, optional minor additions of B and/or Zr, balance Ni. These alloys are cast into shape; examples are GTD 222, IN 939, IN 6203 DS and Udimet 500.

3. 0.07 to 0.1 C, 12 to 16 Cr, 8 to 10 Co, 1.5 to 2 Mo, 2.5 to 4 W, 1.5 to 5 Ta, 0 to 1 Nb, 3 to 4 Al, 3.5 to 5 Ti, 0 to 0.1 Zr, 0 to 1 Hf, an optional minor addition of B, balance Ni. These alloys are cast into shape; examples are IN 738 LC, GTD 111, IN 792 and PWA 1483 SX.

4. 0.2 to 0.7 C, 24 to 30 Cr, 10 to 11 Ni, 7 to 8 W, 0 to 4Ta, 0 to 0.3 Al, 0 to 0.3 Ti, 0 to 0.6 Zr, an optional minor addition of B, balance cobalt. These alloys are cast into shape; examples are FSX 414, X 45, ECY 768 and MAR-M-509.

A standard practice in placing a thermal barrier coating on a substrate of an article of manufacture includes developing an oxide layer on the article, either by placing a suitable bonding layer on the article which develops the oxide layer on its surface under oxidizing conditions or by selecting a material for the article which is itself capable of developing an oxide layer on its surface. That oxide layer is then used to anchor the thermal barrier layer placed on it subsequently.

Under thermal load, diffusion processes will occur within the article. In particular, diffusion active chemical elements like hafnium, titanium, tungsten and silicon which form constituents of most superalloys used for the articles considered may penetrate the oxide layer and eventually migrate into the thermal barrier layer. The diffusion active chemical elements may cause damage to the thermal barrier layer by modifying and eventually worsening its essential properties. That applies in particular to a thermal barrier layer made from a zirconia compound like partly stabilized zirconia, since almost all zirconia compounds must rely on certain ingredients to define and stabilize their particular properties. The action of such ingredients is likely to be imparted by chemical elements migrating into a compound, be it by diffusion or otherwise. Likewise, the anchoring property of the oxide layer may be decreased partly or wholly by diffusion active chemical elements penetrating it.

In order to assure that a protective coating system including a thermal barrier layer placed on a substrate containing diffusion active chemical elements keeps its essential properties over a time period as long as may be desired, it is therefore material to prevent migration of diffusion active chemical elements.

Another relevant aspect in this context is the relatively poor thermal conductivity of alumina which can cause a hot zone to be created at the oxide layer in cooperation with heat reflection effects. Such a hot zone will cause high internal stresses to develop therewithin. These stresses may pertain considerably to a failure of a protective coating system including a thermal barrier layer on such an anchoring layer due to spallation which occurs within the anchoring layer or at an interface between the thermal barrier layer and the anchoring layer. In order to ensure a long life for the protective coating system and keep the oxidation of the bonding layer particularly low, care must be taken to transfer all the heat through the thermal barrier layer to the substrate and a cooling system which may be provided therein.

These aspects have, however, not yet received considerable attention by those working in the field. Heretofore, only an oxide layer has been given consideration to anchor a thermal barrier layer on a superalloy substrate regardless of its transmission of diffusing chemical elements to the thermal barrier layer and its poor thermal conductivity.

SUMMARY OF THE INVENTION

It is accordingly an object of the invention to provide an article with a protective coating system including an improved anchoring layer and a method of manufacturing the same, which overcome the hereinafore-mentioned disadvantages of the heretofore-known products and methods of this general type and which keep to a minimum or prevent the transmission of diffusing elements through an anchoring layer to a thermal barrier layer and allow for sufficient heat transmission through the anchoring layer.

With the foregoing and other objects in view there is provided, in accordance with the invention, an article of manufacture, including: a substrate formed of a nickel or cobalt-based superalloy; an anchoring layer placed on the substrate, the anchoring layer including a nitride compound; and a ceramic coating placed on the anchoring layer. Between the substrate and the anchoring layer there can be interposed a bonding layer.

A basic feature of the invention resides in replacing the oxide layer which has formed the anchoring layer within the protective coating system by an anchoring layer including a nitride compound, particularly aluminum nitride. Thereby, the relatively high thermal conductivity of aluminum nitride, which amounts up to 140 W/mK as opposed to a value between 30 W/mK at room temperature and 7.6 W/mK at 1000° C. for alumina, as well as the relatively low ion transmission property of aluminum nitride are utilized to improve the relevant parameters of the anchoring layer. Particularly, the nitride compound is formed essentially of aluminum nitride.

The invention further relates to an article of manufacture, including a substrate formed of a nickel or cobalt-based superalloy, an anchoring layer disposed on the substrate, the anchoring layer including a nitride compound, and a ceramic coating disposed on the anchoring layer, whereby the nitride compound includes chromium nitride.

In accordance with an added embodiment of the invention, the anchoring layer is formed essentially of the nitride compound. In this context, it should be noted that aluminum in particular will preferably react with oxygen, if both nitrogen and oxygen are present. If oxygen and nitrogen are present in proportions similar to their proportions in air, it must be expected that only reactions between aluminum and oxygen will occur. This requires particular precautions to suppress the presence of oxygen if aluminum nitride is to be prepared by some reaction between elementary aluminum and nitrogen, particularly in the context of a reactive deposition process. Likewise, it must be expected that a compound formed by reacting nitrogen with aluminum contains a certain amount of compounds formed with oxygen, such as ordinary alumina. Such oxygen-containing compounds may eventually form inclusions within a matrix of aluminum nitride. In the present context, aluminum is a metal which has particular importance; however, the above consideration will apply to other metals as well, particularly to chromium.

In accordance with an additional embodiment of the invention, the article includes a diffusion active chemical element covered by the anchoring layer. The diffusion active chemical element is preferably an element selected from the group formed of hafnium, titanium, tungsten and silicon. In particular, the diffusion active element is contained in the substrate or a bonding layer disposed thereon.

Diffusion of the elements mentioned in the preceding paragraph is not considerably inhibited by ordinary alumina. Aluminum nitride, however, can act as an efficient diffusion barrier for these elements, since the nitrogen ions present within the aluminum nitride efficiently hinder a migration of atoms through the material. An additional advantage in this context is a reduced transmission of oxygen from the outside of the article and through the anchoring layer, since the nitrogen ions within the nitride compound also hinder the migration of oxygen ions. Thereby, it must be expected that oxidation of the material whereon the anchoring layer is disposed, namely a bonding layer or a substrate with special properties as explained, will occur at a rate which will be considerably lower than a rate of oxidation which must be expected with a usual anchoring layer in the form of oxides. In summary, both a depletion of a substrate or a bonding layer of diffusion active elements as well as oxidation of the substrate or bonding layer are inhibited, and the lifetime of the article with the protective coating system will be greatly enhanced.

In accordance with a further embodiment of the invention, the ceramic coating includes $ZrO_2$. In a further development, the ceramic coating is formed essentially of $Zro_2$ and a stabilizer selected from the group formed of $Y_2O_3$, $CeO_2$, LaO, CaO, $Yb_2O_3$ and MgO.

In a preferable embodiment, the anchoring layer has a thickness of less than 1 $\mu$m. In particular, this thickness is between 0.1 gm and 0.4 Am. In any event, the thickness of the anchoring layer is selected by taking into account the relatively small coefficient of thermal extension of aluminum nitride which is $3.6\times10^{-6}$/K at room temperature to $5.6\times10^{-6}$/K at 1000° C., to be compared with $6.2\times10^{-6}$/K at room temperature to $8.6\times10^{-6}$/K at 1000° C. for alumina. In order to keep the mechanical stresses low in the anchoring layer, the thicknesses as mentioned are considered to be particularly effective.

In accordance with again a further embodiment of the invention, the article is provided with a bonding layer interposed between the substrate and the anchoring layer.

In preferred embodiments, the bonding layer is formed of a metal aluminide, or it is formed of an MCrAlY alloy.

In accordance with a particularly preferred embodiment of the invention, the ceramic coating has a columnar grained structure and the anchoring layer has a surface whereon the ceramic coating is placed, the surface having a surface roughness $R_a$ less than 5 $\mu$m. Preferably, the surface roughness $R_a$ is less than 2 $\mu$m. Particularly, the anchoring layer has a thickness more than 0.1 $\mu$m. The parameter $R_a$ characterizes a surface roughness in terms of an arithmetical mean deviation of the surface from a smooth mean profile along a measuring line of suitable length and form defined on the surface. Since $R_a$ is thus an integral value, it is evident that it will be virtually independent of particular properties of the measuring line, provided that it is long enough to avoid influences of statistical fluctuations yet short enough to retain its significance for the surface under consideration.

The article as embodied according to the preceding paragraph features a ceramic coating which is of a columnar grained structure, which is expected to have superior mechanical properties. A columnar grained structure has crystallites in the form of small columns disposed one beside the other on the anchoring layer, thus allowing for almost free expansion of the substrate under thermal stress, assuring a particularly high lifetime for the protective coating system. Within that embodiment, bonding between the ceramic coating and the thermal barrier layer must be effected by a solid-state chemical bond. That bond is provided preferably by polishing the article within the course of placing (deposing, adhering) the different layers to achieve a surface roughness as specified.

In accordance with another preferred embodiment of the invention, the ceramic coating has an equiaxial structure and the anchoring layer has a surface whereon the ceramic coating is placed, the surface having a surface roughness $R_z$, greater than 35 $\mu$m and a surface roughness $R_a$ greater than 6 $\mu$m, particularly a surface roughness $R_z$, between 50 $\mu$m and 70 $\mu$m and a surface roughness between $R_a$, between 9 $\mu$m and 14 $\mu$m. The parameter $R_a$ has already been explained. The parameter $R_z$ characterizes a surface roughness in terms of an average peak-to-valley height of the surface, where peak-to-valley heights of five individual measuring lines defined on the surface under consideration are averaged. $R_z$ is thus a mean value for a maximum distance between a peak projecting out of the body having the surface and a valley projecting into the body. Both $R_a$ and $R_z$ are standard parameters, known in the art and defined as such in German norm DIN 4762, for example.

In the embodiment specified in the preceding paragraph, the ceramic coating has a particularly simple structure which allows for a particularly simple depositing process. As opposed to a ceramic coating with a columnar grained structure which must generally be applied by a special PVD process, a ceramic coating with an equiaxial structure can be placed by simple atmospheric plasma spraying. A ceramic coating of this type may not have the superior lifetime characteristic of a columnar grained ceramic coating, but it can be deposited in a particularly cheap way which makes it, within suitable compromises, also particularly useful. In this context, the anchoring layer, as well as the substrate itself or the bonding layer if present, can be left with a considerable surface roughness which may be obtained by simply applying the bonding layer by a process like vacuum plasma spraying and a-voiding any surface smoothing treatment.

The fairly rough surface of the anchoring layer will then retain the ceramic coating not only by a chemical bond, but also by mechanical clamping.

In accordance with yet an added embodiment of the invention the substrate, the bonding layer (if present), the anchoring layer and the ceramic coating form a gas turbine component. In particular, the gas turbine component is a gas turbine airfoil component including a mounting portion and an airfoil portion, the mounting portion being adapted to fixedly hold the component in operation and the airfoil portion being adapted to be exposed to a gas stream streaming along the component in operation, the anchoring layer and the ceramic layer placed on the airfoil portion.

With the above-mentioned and other objects in view, there is also provided, in accordance with the invention, a method of applying a ceramic coating to an article of manufacture having a substrate formed of a nickel or cobalt-based superalloy. Particularly, the substrate may have a bonding layer placed thereon, as described hereinabove. The method includes the following steps: placing (deposing) an anchoring layer including a nitride compound on a substrate formed of a nickel or cobalt-based superalloy; and placing a ceramic coating on the anchoring layer.

In accordance with an additional mode of the invention, the step of placing the anchoring layer is performed by physical vapor deposition. Preferably, a physical vapor deposition process including sputtering or electron beam evaporation is used.

In accordance with another mode of the invention, the step of placing the anchoring layer includes:

establishing an atmosphere containing nitrogen around the layer, creating the anchoring layer by subjecting the layer and the atmosphere to an elevated temperature;

placing at least one metal to a surface of the substrate-and reacting the metal with the nitrogen to form the nitride compound.

In accordance with a further mode of the invention, a plasma containing ionized nitrogen is formed around the substrate. Thereby reactions between nitrogen and metal compounds to form the desired nitride compound are facilitated.

In accordance with an additional mode of the invention, the metal is placed on the substrate by coating the substrate with the metal. Alternatively, the metal can be placed on the substrate by diffusing the metal out of the substrate or out of a bonding layer priorly placed on the substrate.

In accordance with yet another mode of the invention, the metal is selected from the group formed of aluminum and chromium.

In accordance with a particularly preferred mode of the invention, the surface is prepared on the substrate, eventually on a bonding layer placed on the substrate, the surface having a surface roughness $R_a$, less than 2 $\mu$m, prior to placing the anchoring layer on the surface, and the ceramic layer is placed with a columnar grained structure. In this context, the surface is prepared preferably by polishing. Also preferably, a bonding layer is placed on the substrate, and the surface is prepared on the bonding layer. With further preference, the ceramic layer in this context is placed by physical vapor deposition, particularly to form a ceramic layer having a columnar grained structure. The formation of such structure may require that some kind of epitaxial growth is effected when placing the ceramic coating, to ensure that the desired columns of ceramic material are obtained.

In accordance with an alternative preferred mode of the invention, the surface is prepared on the substrate, the surface having a surface roughness $R_z$ between 40 $\mu$m and 50 $\mu$m, prior to placing the anchoring layer on the surface, and the ceramic layer is placed with an equiaxial structure. Particularly, the surface is prepared by placing a bonding layer on the substrate by vacuum plasma spraying, establishing the surface on the bonding layer and leaving the surface without smoothing treatment. In this context, the ceramic layer may be placed by atmospheric plasma spraying to obtain an equiaxial structure.

Other features which are considered as characteristic for the invention are set forth in the appended claims.

Although the invention is illustrated and described herein as embodied in an article with a protective coating system including an improved anchoring layer and a method of manufacturing the same, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of the specific embodiment when read in connection with the accompanying drawings.

DESCRIPTION OF THE PREFERRED EMBODIMENTS

Figure 1:
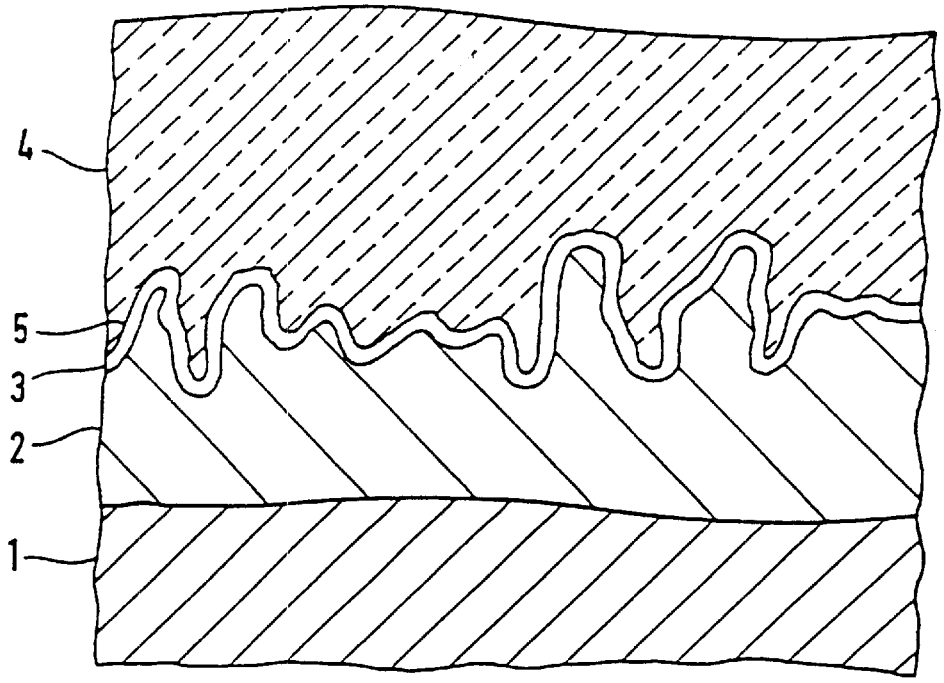
FIGS. 1 to 3 are fragmentary, diagrammatic, cross-sectional views of substrates having a respective protective coating system incorporating a ceramic coating adhered thereon.
Figure 2:
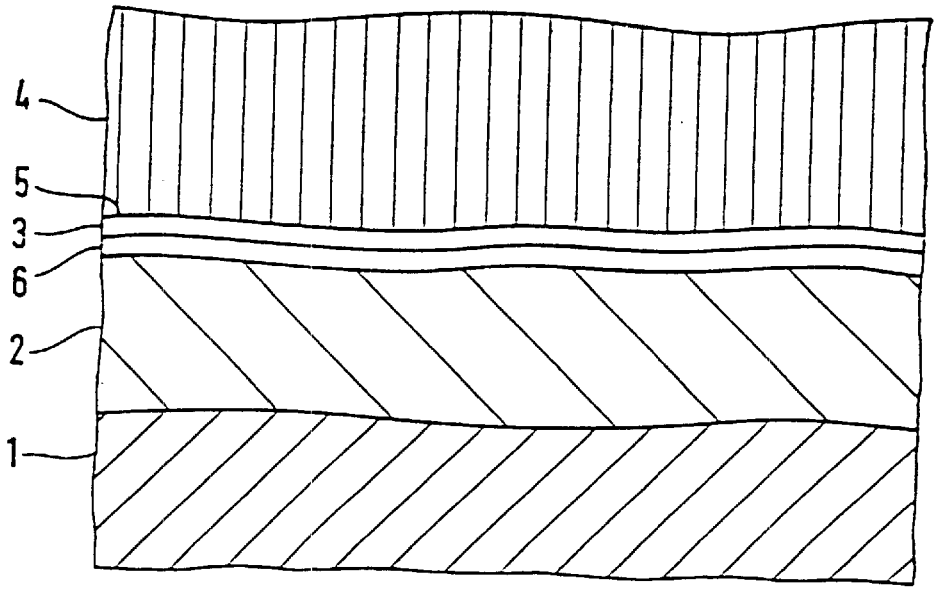
Figure 3:
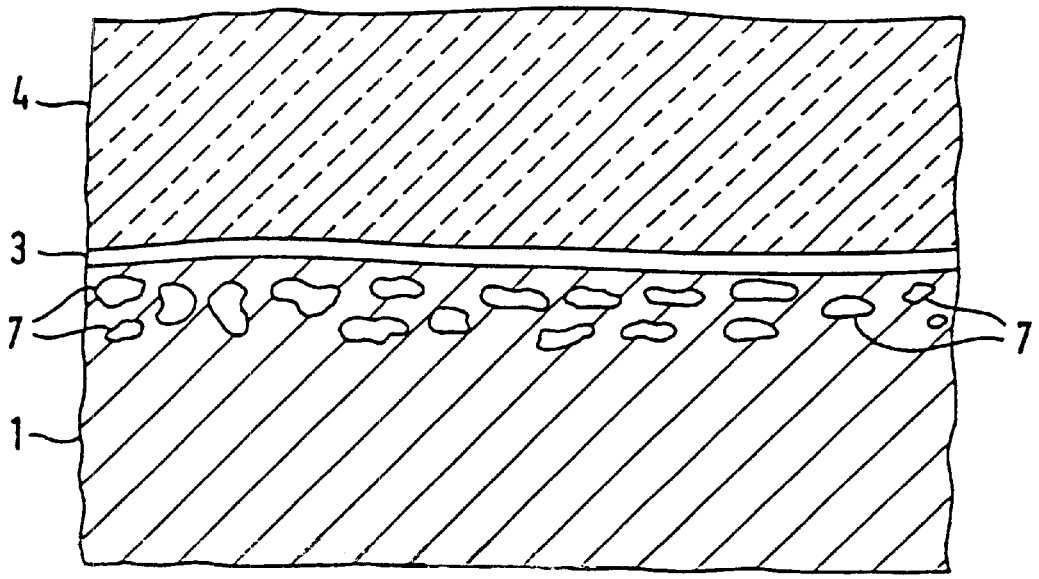

Referring now to the figures of the drawing in detail and first, particularly, to FIGS. 1 to 3 thereof, there is seen a respective substrate 1 of an article of manufacture, in particular a gas turbine component, which in operation is subject to heavy thermal load and concurrently to corrosive and erosive attack. The substrate 1 is formed of a material which is suitable to provide strength and structural stability when subjected to a heavy thermal load-and eventually an additional mechanical load by severe forces like centrifugal forces. A material which is widely recognized and employed for such a purpose in a gas turbine engine is a nickel or cobalt-based superalloy. Particularly preferred are a nickel-based superalloy which is specified as PWA 1483 SX and a cobalt-based superalloy which is specified as MAR-M-509, both specifications by usual standard.

The composition of the superalloy PWA 1483 SX specified in terms of parts per weight, is as follows: Carbon 0.07%; chromium 12.2%; cobalt 9.0%; molybdenum 1.9%; tungsten 3.8%; tantalum 5.0%; aluminum 3.6%; titanium 4.2%; boron 0.0001%; zirconium 0.002%; balance nickel.

The composition of the superalloy MAR-M-509, specified in terms of parts per weight, is as follows: Carbon 0.65%-chromium 24.5%; nickel 11%; tungsten 7.5%; tantalum 4.0%; titanium 0.3%; boron 0.010%; zirconium 0.60%; balance cobalt.

The compositions are specified by way of example. In any case, the alloys should be made in accordance with the usual specifications and the general knowledge of those skilled in the art.

In order to limit the thermal load imposed on the substratel, a ceramic coating or thermal barrier layer 4 is placed thereon, formed essentially of a stabilized or partly stabilized zirconia. The thermal barrier layer 4 is anchored to the substrate 1 by means of an anchoring layer 3.

According to FIGS. 1 and 2, the anchoring layer 3 is placed on a bonding layer 2 which has been placed on the substrate 1, which in these cases is preferably made from the superalloy PWA 1483 SX. The bonding layer 2 is formed of an MCrAlY alloy and preferably of an MCrAlY alloy as disclosed in one of U.S. Pat. Nos. 5,154,885; 5,268,238; 5,273,712; and 5,401,307. The bonding layer 2 has certain functions in common with a bonding layer as known from the state of the art and in particular has a tight bond to the substrate 1. The anchoring layer 5 serves as an anchor for the thermal barrier layer 4.

FIG. 1 shows an embodiment of the invention where the ceramic coating 4 is made from a ceramic with no particular microscopic orientation, namely a ceramic with an equiaxial structure. Such ceramic is easily and cheaply applied by atmospheric plasma spraying. The use of such ceramic may involve some compromises relating to the lifetime which may be attainable for the article; however, as the application of the ceramic is done in a particularly cheap way, it can be tolerated that the ceramic must be replaced at relatively frequent intervals. In order to anchor such ceramic coating 4 on the anchoring layer 3 and the bonding layer 2, it is preferred to prepare the bonding layer 2 and the anchoring layer 3 with a surface 5 whereon the ceramic is to be placed which is fairly rough, in particular as specified hereinabove. Thereby, the ceramic coating 4 will not only be bonded to the substrate by some kind of chemical bond provided by a solid-state chemical reaction, but also by mechanical clamping provided by the various structures on the surface 5. As already mentioned, a desired roughness of the surface 5 can be provided by applying the bonding layer 2 by a process like vacuum plasma spraying and simply leaving the bonding layer without any smoothing treatment. Peening of the bonding layer with glass beads or the like may eventually be used to compress the bonding layer 2 and avoid any voids therein; such peening is not likely to substantially smoothen the bonding layer 2 and thus not regarded to be representative of a smoothing treatment.

FIG. 2 shows a different ceramic coating 4, which is likely to feature indeed superior properties. According to FIG. 2, the ceramic coating 4 is provided as a columnar grained ceramic which must be applied by a sophisticated process like PVD. By such process, the ceramic coating will grow almost epitaxially on the substrate 1, and a multiplicity of small columns, one beside the other on the surface 5, will form. Since the ceramic coating 4 is formed of individual columns, it is not likely to spall or break as the protective coating system 2,3,4 and the substrate 1 are subjected to a thermal load. However, the ceramic coating according to FIG. 2 is likely to be much more expensive than the ceramic coating 4 according to FIG. 1. In order to apply a ceramic coating 4 as shown in FIG. 2, it is preferred to provide the surface 5 whereon the ceramic coating 4 is to be placed with fairly little roughness; it is indeed preferred to polish the bonding layer 2, eventually even the substrate 1 as well, prior to application of the anchoring layer 3. Preferred properties of the surface 5 and to be attained as explained have been specified hereinabove.

FIG. 2 shows also an oxide layer 6 between the anchoring layer 3 and the bonding layer 2. In most cases this oxide layer 6 will be composed of alumina which has formed from aluminum diffusing out of the bonding layer 2 and oxygen penetrating through the ceramic coating 4 and the anchoring layer 3. As the substrate 1 with its protective coating system is subjected to a hot oxidizing gas stream in operation in a gas turbine, a steady oxidation process at an interface between the anchoring layer 3 and the bonding layer 2 must be expected; accordingly, the oxide layer 6 is very likely to form and grow steadily, and a failure of the protective coating system must be expected after the oxide layer 6 has increased over a critical thickness. If the oxide layer 6 becomes too thick, it is likely to develop internal cracks and the like, which will ultimately lead to spalling. By providing the anchoring layer 3 in accordance with the invention, it is expected that transmission of oxygen through the anchoring layer is greatly reduced as compared to prior art anchoring layers, and thus a prolonged lifetime of the protective coating system is expected.

FIG. 3 shows another embodiment of the invention, where no bonding layer 2 as in FIGS. 1 and 2 is used. The anchoring layer 3 is placed directly on the substrate 1, and the ceramic layer is placed on the anchoring layer 3. Preferred embodiments of the ceramic layer 4 as shown in FIG. 1 and FIG. 2 may be used. As the anchoring layer 3 is placed immediately on the substrate 1, it is of particular importance that a suitable material for the substrate 1 is selected. In particular, the cobalt-based superalloy MAR-M-509 has proved to be effective; an important feature in this respect is to use an alloy which is capable of developing a protective oxide layer on its surface under oxidizing treatment. FIG. 3 shows a feature which illustrates the capability of a nitride compound like aluminum nitride or chromium nitride to be bonded to an alloy. Namely, nitride inclusions 7 are formed within the substrate 1 below the anchoring layer 3, demonstrating that nitrogen is capable to diffuse into the substrate 1 and provide for the desired bonding between the anchoring layer 3 and the substrate 1. In fact, a mixing zone will be created where a more or less smooth transition from the anchoring layer 3 to the undistorted substrate 1 is provided and where nitride inclusions 7 may form with aluminum, chromium or other nitride-forming constituents of the material of the substrate 1.

Referring now again to FIGS. 1 to 3 in common, it should be noted that due to the very high affinity of aluminum and even chromium to oxygen, it must be expected that not only aluminum nitride and/or chromium nitride will be formed if oxygen is present besides nitrogen, even if only in a minor amount. Accordingly, it must be expected, that the anchoring layer 3 formed as explained contains inclusions which are formed with oxygen and which may be composed of simple oxides or ternary compounds including at least one metal besides oxygen and nitrogen. It is preferred however to keep the oxygen content of the anchoring layer 3 as low as possible and to avoid a formation of such inclusions 7 as much as possible.

The drawing is not intended to show the thicknesses of the layers 2,3,4 and 6 to scale; the thickness of the anchoring layer 3 might in reality be very much less than the thickness of the bonding layer 2, as specified hereinabove.

In any case, the anchoring layer 3 can be made by several methods, in particular by a physical vapor deposition process like electron beam PVD, sputter ion plating and cathodic arc-PVD, or by thermal treatment of a metal layer in a nitrogen-containing atmosphere. Such thermal treatment is in particular carried out at a temperature within a range between 700° C. and 1100° C. A nitrogen-containing atmosphere may also serve to provide the nitrogen for a PVD-process, which includes evaporating the required metal from a suitable source and adding the nitrogen from the atmosphere. As an alternative, the metal can be provided by diffusing it out of the substrate 1 or a bonding layer 2 applied thereto and reacting the metal with nitrogen as explained just before. In any case, the reactivity of the nitrogen can be increased by forming a nitrogen-containing plasma around the substrate 1, as explained hereinabove.

Figure 4:
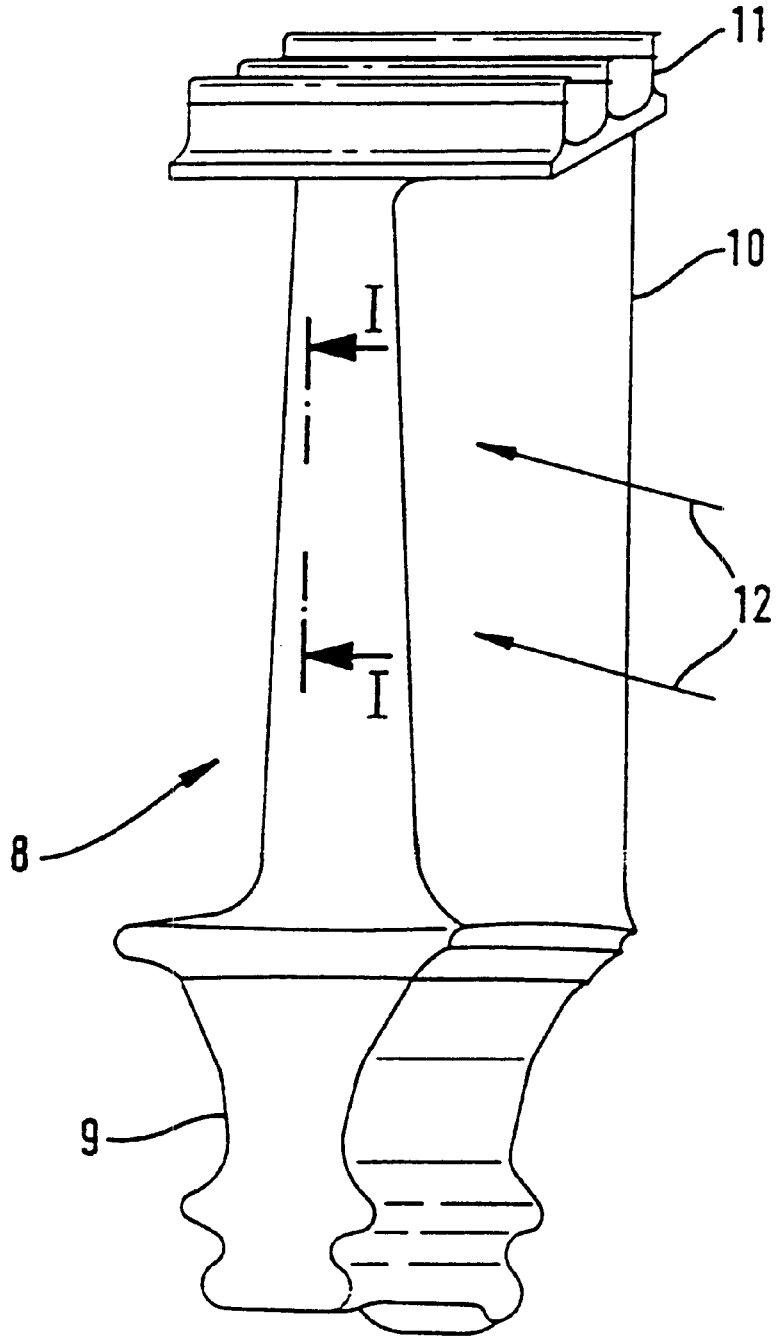
FIG. 4 is a perspective view of a gas turbine airfoil component including the substrate and protective coating system shown in FIG. 1.

FIG. 4 shows a complete gas turbine component 8, namely a gas turbine airfoil component 8, in particular a turbine blade. The component 8 has an airfoil portion 10, which in operation forms an "active part" of the gas turbine engine, a mounting portion 9, at which the component 8 is fixedly held in its place, and a sealing portion 11, which forms a seal together with adjacent sealing portions of neighboring components to prevent an escape of a gas stream 12 flowing along the airfoil portion 10 during operation.

The section of FIG. 1 is taken along the line I—I in FIG. 2.

Figure 5:
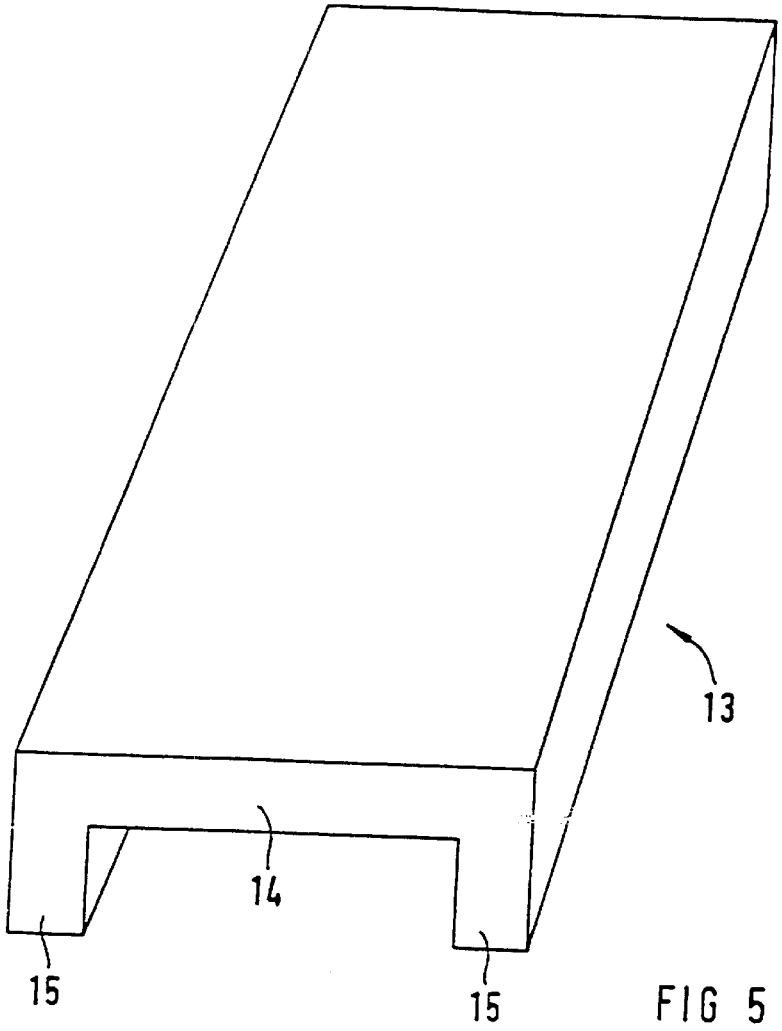
FIG. 5 is a perspective view of a gas turbine heat shield component.

FIG. 5 shows another gas turbine component 13, namely a gas turbine heat shield component 13. This component 13 has a shielding portion 14, which in operation forms an "active part" of the gas turbine engine, namely a hot gas channel thereof, and mounting portions 15. In order to construct a mounting portion 15, many options are known. For the sake of simplicity, the mounting portions 15 are shown in the form of rails 15 whereat the component 13 can be fixed. However, no claim is made that this structure is particularly effective.

Figure 6:
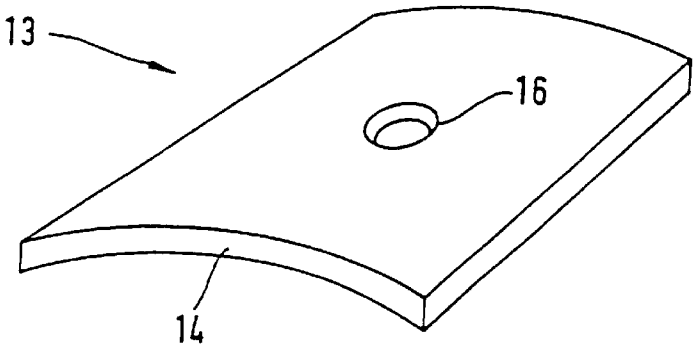
FIG. 6 is a perspective view of another gas turbine heat shield component.

FIG. 6 shows a preferred structure for a gas turbine heat shield component 13. This gas turbine heat shield component 13 has a shielding portion 14 formed as a curved plate. For fastening, a hole 16 to be penetrated by a fastening bolt or the like is provided.

Referring again to FIG. 1, particular advantages of the novel combination of the anchoring layer 3 and the thermal barrier layer 4 can be summarized as follows: As the anchoring layer 3 has a high content of nitride compounds, it is indeed very suitable for anchoring a thermal barrier layer 4. That thermal barrier layer 4 may expediently be deposited on the substrate 1 immediately after deposition of the anchoring layer 3 and in particular within the same apparatus and by using as much as possible installations which have been already in use for depositing the anchoring layer 3. The combination of the anchoring layer 3 and the thermal barrier layer 4 thus made has all the advantages of such combinations known from the prior art and additionally features a substantially prolonged lifetime due to a reduced oxidation of layers of the article below the anchoring layer 3, an improved heat transmission through the anchoring layer 3 and a good suppression of migration of diffusion active elements into the thermal barrier layer 4.

I claim:

1. An article of manufacture, comprising:

a substrate formed of a nickel or cobalt-based superalloy;

an anchoring layer placed on said substrate, said anchoring layer containing a nitride compound for inhibiting diffusion;

a bonding layer chemically different from said anchoring layer and interposed between said substrate and said anchoring layer; and a ceramic coating placed on said anchoring layer.

2. The article according to claim 1, wherein said nitride compound comprises aluminum nitride and/or chromium nitride.

3. The article according to claim 2, wherein said nitride compound consists essentially of aluminum nitride.

4. The article according to claim 1, including a diffusion active chemical element covered by said anchoring layer.

5. The article according to claim 4, wherein said diffusion active chemical element is an element selected from the group consisting of hafnium, titanium, tungsten and silicon.

6. The article according to claim 1, wherein said ceramic coating includes $ZrO_2$.

7. The article according to claim 6, wherein said ceramic coating consists essentially of $Zro_2$ and a stabilizer selected from the group consisting of $Y_2O_3$, $CeO_2$, LaO, CaO, $Yb_2O_3$, and MgO.

8. The article according to claim 1, wherein said anchoring layer has a thickness less than 1 $\mu$m.

9. The article according to claim 8, wherein said thickness is between 0.1 $\mu$m and 0.4 $\mu$m.

10. The article according to claim 1, comprising a bonding layer interposed between said substrate and said anchoring layer.

11. The article according to claim 10, wherein said bonding layer is formed of a metal aluminide.

12. The article according to claim 10, wherein said bonding layer is formed of an MCrAlY alloy.

13. The article according to claim 1, wherein said ceramic coating has a columnar grained structure, and wherein said anchoring layer has a surface whereon said ceramic coating is placed, said surface having a surface roughness $R_a$ less than 5 gm.

14. The article according to claim 13, wherein said surface roughness $R_a$ is less than 2 $\mu$m.

15. The article according to claim 13, wherein said anchoring layer has a thickness more than 0.1 $\mu$m.

16. The article according to claim 1, wherein said ceramic coating has an equiaxial structure, and wherein said anchoring layer has a surface whereon said ceramic coating is placed, said surface having a surface roughness $R_z$ greater than 35 $\mu$m and a surface roughness $R_a$, greater than 6 $\mu$m.

17. The article according to claim 16, wherein said surface roughness $R_z$ is between 50 $\mu$m and 70 $\mu$m and said surface roughness $R_a$, is between 9 $\mu$m and 14 $\mu$m.

18. The article according to claim 1, wherein said substrate, said anchoring layer and said ceramic coating form a gas turbine component.

19. The article according to claim 18, wherein said gas turbine component is a gas turbine airfoil component comprising a mounting portion and an airfoil portion, said mounting portion being adapted to fixedly hold the component in operation and said airfoil portion being adapted to be exposed to a gas stream streaming along said component in operation, said anchoring layer and said ceramic layer placed on said airfoil portion.

20. The article according to claim 1, wherein said anchoring layer consists essentially of said nitride compound.

21. An article of manufacture, comprising:

a substrate formed of a nickel or cobalt-based superalloy;

an anchoring layer placed on said substrate, said anchoring layer containing a nitride compound for inhibiting diffusion, wherein said nitride compound contains chromium nitride; and a ceramic coating placed on said anchoring layer, said ceramic coating including $ZrO_2$.

22. The article according to claim 21, wherein said ceramic coating consists essentially of $Zro_2$ and a stabilizer selected from the group consisting of $Y_2O_3$, $CeO_2$, LaO, CaO, $Yb_2O_3$, and MgO.

23. An article of manufacture, comprising:

a substrate formed of a nickel or cobalt-based superalloy;

an anchoring layer placed on said substrate, said anchoring layer containing a nitride compound for inhibiting diffusion, wherein said nitride compound contains chromium nitride;

a ceramic coating placed on said anchoring layer; and a bonding layer interposed between said substrate and said anchoring layer.

24. The article according to claim 23, wherein said bonding layer is formed of a metal aluminide.

25. The article according to claim 23, wherein said bonding layer is formed of an MCrAlY alloy.

26. An article of manufacture, comprising:

a substrate formed of a nickel or cobalt-based superalloy;

an anchoring layer placed on said substrate, said anchoring layer containing a nitride compound for inhibiting diffusion, wherein said nitride compound contains chromium nitride, said anchoring layer having a surface whereon said ceramic coating is placed, said surface having a surface roughness $R_a$ less than 5 $\mu$m; and a ceramic coating placed on said anchoring layer, said ceramic coating having a columnar grained structure.

27. The article according to claim 26, wherein said surface roughness $R_a$ is less than 2 $\mu$m.

28. The article according to claim 26, wherein said anchoring layer has a thickness more than 0.1 $\mu$m.

29. An article of manufacture, comprising:

a substrate formed of a nickel or cobalt-based superalloy;

an anchoring layer placed on said substrate, said anchoring layer containing a nitride compound for inhibiting diffusion, wherein said nitride compound contains chromium nitride, said anchoring layer having a surface whereon said ceramic coating is placed, said surface having a surface roughness $R_z$ greater than 35 $\mu$m and a surface roughness $R_a$, greater than 6 $\mu$m; and a ceramic coating placed on said anchoring layer; said ceramic coating has an equiaxial structure.

30. The article according to claim 29, wherein said surface roughness $R_z$ is between 50 $\mu$m and 70 $\mu$m and said surface roughness $R_a$, is between 9 $\mu$m and 14 $\mu$m.

* * * * *